US005964370A

United States Patent [19]

Rust, Jr. et al.

[11] Patent Number: 5,964,370

[45] Date of Patent: Oct. 12, 1999

[54] CONDENSATE PAN WITH MINIMAL RESIDUAL CONDENSATE

[75] Inventors: Raymond A. Rust, Jr., Gosport; Timothy J. Perry, Zionsville; Mark D. Singer; Randall D. Allen, both of Indianapolis; John A. Wade, Greenwood; Richard D. Watkins, Indianapolis, all of Ind.

[73] Assignee: Carrier Corporation, Syracuse, N.Y.

[21] Appl. No.: 08/933,898

[22] Filed: Sep. 19, 1997

Related U.S. Application Data

[62] Division of application No. 08/763,339, Dec. 11, 1996, Pat. No. 5,715,697.

[51] Int. Cl.[6] ..... B65D 1/34

[52] U.S. Cl. ..... 220/571; 220/676

[58] Field of Search ..... 220/571, 573, 220/DIG. 6, 661, 676

[56] References Cited

U.S. PATENT DOCUMENTS

| | | | |
|---|---|---|---|
| 3,102,654 | 9/1963 | Millman et al. | 220/571 |
| 4,013,105 | 3/1977 | Uuskallio | 220/573 |
| 4,085,773 | 4/1978 | Tinney | 220/571 |
| 4,930,648 | 6/1990 | Hundt | 220/676 |
| 5,071,027 | 12/1991 | Sullivan | 220/571 |
| 5,562,047 | 10/1996 | Forney et al. | 220/571 |

*Primary Examiner*—Stephen Castellano

[57] ABSTRACT

A condensate pan is adapted for use in either a left or right horizontal fan coil installation, and includes left and right mirror image sides interconnected with a central section having on its lower surface a riser near one end, and each of the halves having a drainage opening on the other end, such that when the evaporator coil is placed in the condensate pan, the pan is tipped about the riser to lower one side and raise the other, depending on whether its a left or right horizontal installation, such that drainage occurs from the lower side drainage opening. The drainage opening is so located with respect to the floor of the pan that, when a drain pipe is threadably connected thereto, its lower inner surface is disposed vertically below the pan floor to thereby enhance its drainage characteristics.

5 Claims, 4 Drawing Sheets

CONDENSATE PAN WITH MINIMAL RESIDUAL CONDENSATE

This application is a division of application Ser. No. 08/763,339, filed Dec. 11, 1996, now U.S. Pat. No. 5,715,697.

BACKGROUND OF THE INVENTION

This invention relates generally to air conditioning systems and, more particularly, to an improved condensate pan for a fan coil unit.

An air conditioning unit of the "split" type is commonly comprised of an outdoor unit, including a compressor and a condenser coil, and an indoor, or fan coil unit, which includes an evaporator coil and a blower for pulling in the return air from the space to be cooled, passing it through the evaporator coil to cool the air, and then delivering the cooled air to the space. Since the temperature of the refrigerant passing through the evaporator coil is often lower than the dew point of the surrounding air, condensation tends to form on the evaporator coil. It is therefore necessary to have a condensate pan located below the coil to collect the condensate that tends to run off the evaporator coil. A drainage fixture is generally provided to drain off the condensate into the sewer or to the outside.

If possible, it is desirable to have the condensate pan relatively dry or with as small a build-up of water as possible. The reason is that standing water is conducive to microbial growth, and such growth can lead to the eventual plugging of condensate lines. This, in turn, results in an overflow of the condensate pan, which can cause damage to both the unit and to the surrounding space.

There are also other problems which commonly occur with condensate pans. For example, since different systems will generally have different air flow volumes and velocities because of different blower settings and ductwork, a system with a relatively high air flow may cause the condensate to blow out of the condensate pan if the water level is too high. Another problem that can occur is a dry trap, wherein air tends to rush up through the trap and inhibit the flow of water therethrough. Finally, in order to promote better drainage from the condensate pan, the installer often slopes the system from a level position, and in so doing may exacerbate or even create drainage problems.

Depending on where the fan coil is installed, it may be upright for either an upflow or a downflow arrangement, or it may be installed horizontally, on either its left or its right side. With the present design of condensate pans, there is provision for a single pan to be used for either left or right side installations, but drainage from those pans has been inadequate.

It is therefore an object of the present invention to provide an improved fan coil condensate pan.

Another object of the present invention is the provision in a fan coil condensate pan for reducing the water level therein and enhancing the drainage therefrom.

Yet another object of the present invention is the provision in a condensate pan for minimizing the loss of water from excessive airflow conditions.

Still another object of the present invention is to be able to begin operation with a dry trap, and "make trap" during uninterrupted operation.

Finally, another object of the present invention is the provision for a fan coil condensate pan which is effective in use and economical to manufacture.

These objects and other features and advantages become more readily apparent upon reference to the following description when taken in conjunction with the appended drawings.

SUMMARY OF THE INVENTION

Briefly, in accordance with one aspect of the invention, a condensate pan is made up of two symmetrical halves integrally connected by a central section, with each half having a drainage opening in one end thereof. On the other end thereof, a riser protrudes downwardly from the bottom of the central section such that when the condensate pan is placed with the central section extending transversely across a horizontally disposed fan coil unit, the floor of the condensate pan is sloped toward the end with the openings therein. When the pan is in the installed condition, the pan is caused to pivot slightly about the central section with the riser acting as a fulcrum such that one of the halves slopes downwardly from the central section and the other half slopes upwardly therefrom, depending whether the fan coil is placed in a horizontally left or right position, respectively. The same pan can be used for the other horizontal installation, in which case the pan would tilt in the other direction and use the other drainage opening for draining off the condensate. In this way, the same condensate pan can be used for either left or right hand horizontal installations.

By another aspect of the invention, each half of the condensate pan floor is comprised of an upper section, a lower section, and a transition section therebetween. The drainage opening is disposed adjacent the upper floor section, and the relative positions of the upper, lower and transition sections are such that the drainage opening is at the lowest elevation of the pan so as to facilitate complete drainage thereof.

By yet another aspect of the invention, the drainage opening in each pan half is comprised of a primary opening and a secondary opening, with the secondary opening being disposed at a higher elevation than the primary opening when in the installed position. If the primary opening becomes plugged, the secondary opening can function to drain the pan.

By yet another aspect of the invention, the primary opening is so disposed in the end wall of the pan that when the drainage pipe is connected to the opening, its lower internal circumference is below the plane of the floor such that complete drainage is facilitated.

In the drawings as hereinafter described, a preferred embodiment is depicted; however, various modifications and alternate constructions can be made thereto without departing from the true spirit and scope of the invention.

DESCRIPTION OF THE PREFERRED EMBODIMENT

Figure 1:
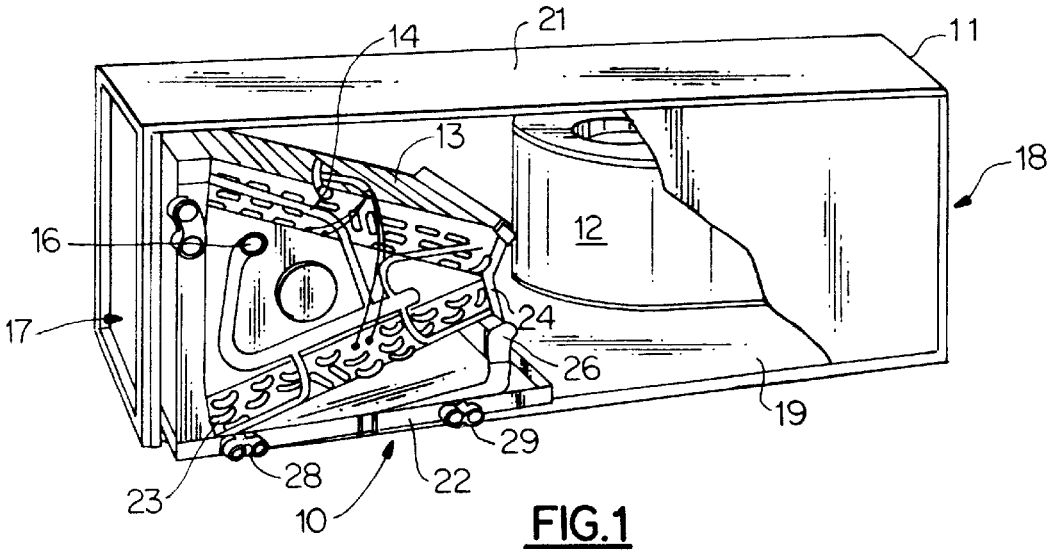
FIG. 1 perspective view of the present invention as installed in a fan coil unit disposed in a horizontal right configuration.

Referring now to FIG. 1, the invention is shown generally at 10 as installed in a fan coil unit 11 having a blower 12 disposed in one end thereof and an evaporator coil 13 disposed in the other end thereof. While the particular type of evaporator coil shown is a so called A-coil, it may take other forms as well. The evaporator coil 13 is fluidly connected by the conduits 14 and 16 to a refrigeration circuit which includes a compressor, a condenser coil, and an expansion device so as to operate in a conventional manner to provide expanded refrigerant vapor to the evaporator coil 13 for cooling air in a conventional manner. The blower 12 causes the return air from the space to be drawn in at the intake end 17, passed through the evaporator coil 13 and delivered from the supply end 18 to the space to be cooled.

Figure 2:
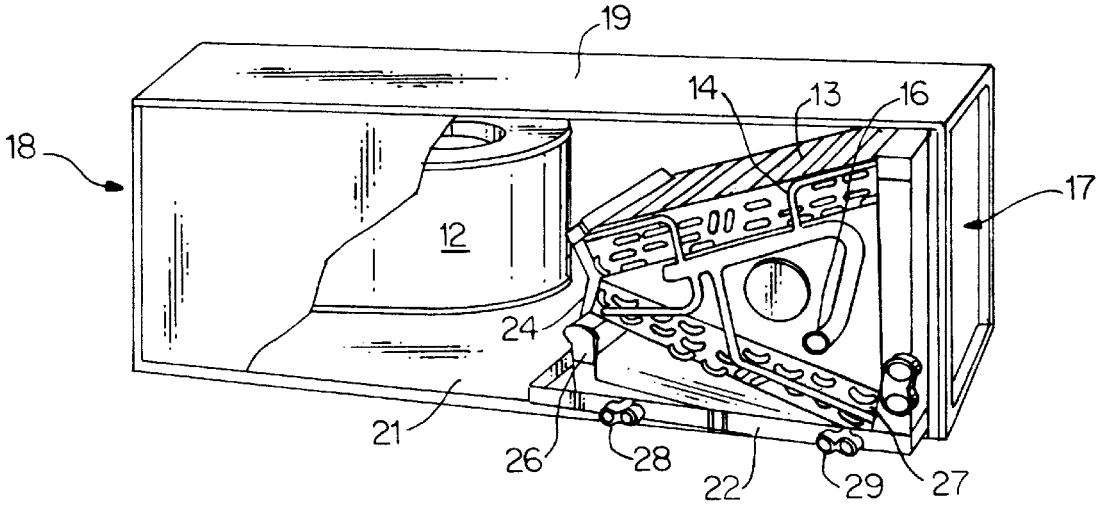
FIG. 2 is a perspective view of the present invention as installed in a fan coil unit disposed in a horizontal left configuration.
Figure 4:
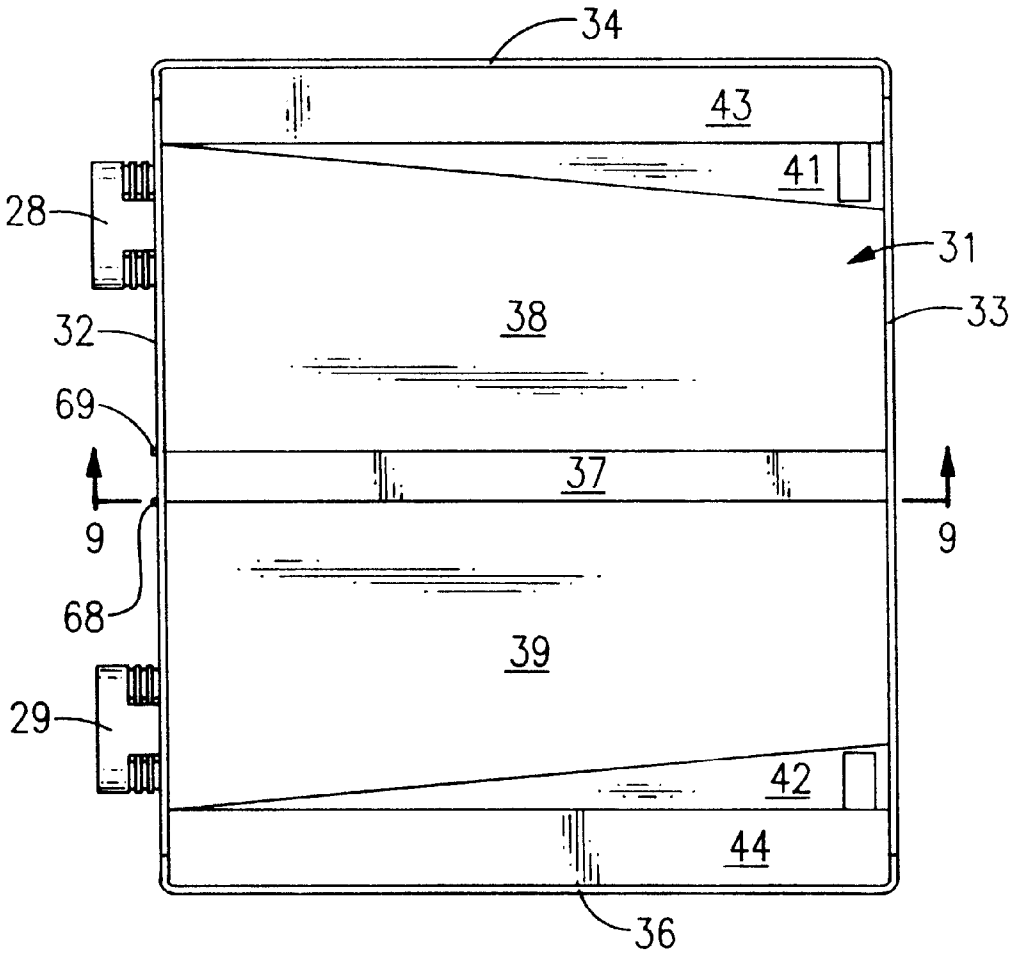
FIG. 4 is a top view of the condensate pan of the present invention.
Figure 3:
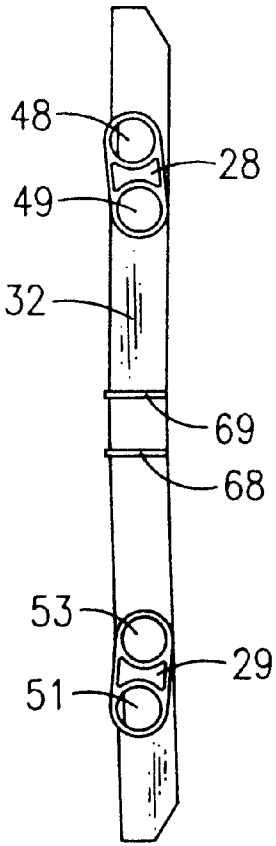
FIG. 3 is a front end view of the condensate pan in accordance with the present invention.
Figure 5:
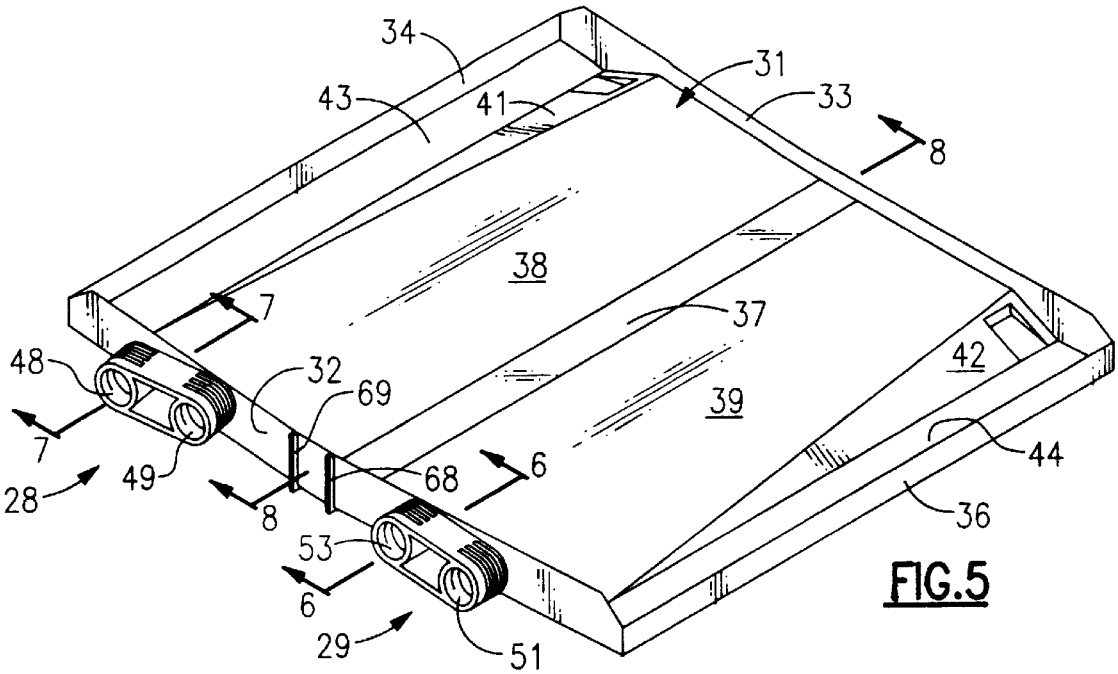
FIG. 5 is a perspective view thereof.

The fan coil 11 is adapted to be installed in an upflow orientation, with the intake opening 17 facing downward or a downflow orientation, with the intake opening 17 facing upward, or in either a horizontal right or horizontal left orientation as shown in FIGS. 1 and 2, respectively. That is, in the horizontal right installation as shown in FIG. 1, the right wall 19 lays flat on a horizontal support surface, whereas in a horizontal left installation as shown in FIG. 2, the left wall 21 lays flat against the horizontal support surface.

A condensate pan 22 is provided below the evaporator coil 13 to collect any condensate dripping off the coil and to drain it away. The condensate pan 22 is preferably made from a plastic or polycarbonate material such as Lexan, but may also be made of a metal material. If plastic, it is preferably made in one piece by injection molding.

The condensate pan 22 is supported by the right wall 19 in the horizontal right installation and by the left wall 21 in the horizontal left installation. The evaporator coil 13 is in turn, disposed above the condensate pan 22 with one foot thereof being in a lower portion of the pan. As shown in FIG. 1, for a horizontal right installation, the A-coil is connected at its feet by way of rails and brackets (not shown) to be cantilevered out from the structure of the opening 17 and with its right foot 23 resting on the left side of the condensate pan 22. The A-coil apex 24 is disposed above a drain tube 26 which is connected to and supported by the right side of the condensate pan 22 as shown. Contrariwise, in the horizontal left installation as shown in FIG. 2, the A-coil left foot 27 is disposed in the right side of the condensate pan 22, and the apex 24 is disposed above a drain tube 26 disposed in the left side of the condensate pan 22.

Drainage from the condensate pan occurs by way of a horizontal right drain 28 in the left side of the condensate pan 22 in the case of the horizontal right installation, whereas in the horizontal left installation, the condensate drains from a horizontal left drain 29 located in the right side of the condensate pan 22 as shown in FIG. 2.

Referring now to FIGS. 3–9, the condensate pan will be described in greater detail. The pan is relatively shallow with a floor 31, front and back end walls 32 and 33, and left and right sidewalls 34 and 36 to define a container for condensate. The condensate pan is constructed of two mirror image halves integrally connected by a central section 37. The floor in each half is then comprised of an upper portion (38 and 39, respectively), a transition portion (41 and 42, respectively), and a lower portion (43 and 44, respectively). The central section 37 is planer in form and, as will be seen in FIGS. 4, 8 and 9, slopes downwardly from the rear wall 33 to the front wall 32. The floor upper portions 38 and 39 are also planer in form and are sloped from the rear wall 33 to the front wall 32, but they are also sloped slightly upwardly as they extend toward their respective sidewalls 34 and 36, respectively. The transition portions 41 and 42 slope downwardly toward their respective sidewalls 34 and 36, with the drop being significant at the rear wall end and diminishing to zero at the front wall 32. Detents 46 and 47 are added to the transition portions 41 and 42, respectively to prevent interference with coil bracketry. The floor lower portions 43 and 44 are planer in form and are substantially flat or level but with one being slightly sloped downwardly from the rear wall 33 to the rear wall 32 when effected by the riser in the installed position as will be described hereinafter. Further, these portions will be displaced above and below, respectively, of a horizontal reference line when the evaporator coil is installed in the condensate pan 22 as will be more fuilly described hereinafter.

Referring now to the horizontal right and left drains, 28 and 29, respectively, it will be seen that each has two openings in the front wall 32. These are the primary and secondary drain openings. That is, the horizontal right drain 28 has a primary drain opening 48 and secondary drain opening 49. Similarly, the horizontal left drain 29 has a primary drain opening 51 and a secondary drain opening 53. It will be seen that for each, the primary drain opening is lower on the face of front wall 32 than is the secondary drain opening.

Figure 6:
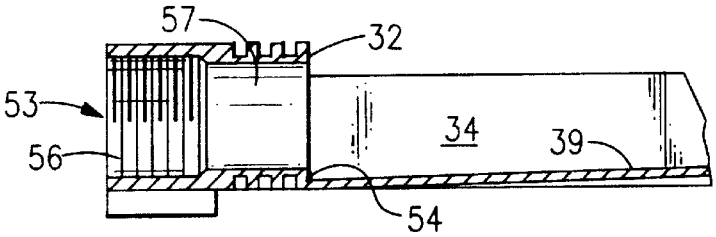
FIG. 6 is a sectional view of one of the drainage opening portions of the present invention as seen along line 6—6 in FIG. 5.
Figure 7:
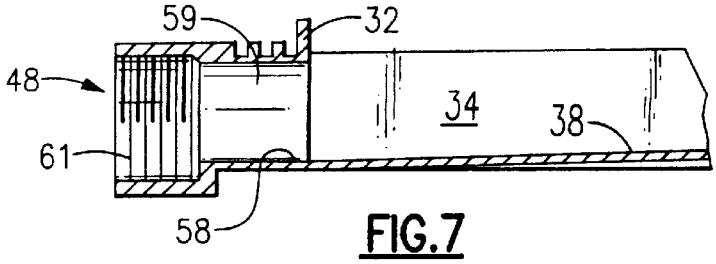
FIG. 7 is a sectional view of the other drainage opening portion of the present invention as seen along line 7—7 of FIG. 5.

This can be better seen by reference to FIGS. 6 and 7 wherein the secondary drain opening 53 is shown to be slightly raised from the floor upper portion 39 to present a lip 54 over which condensate must run prior to entering the opening 53. A pipe or conduit which is screwed into the threaded portion 56 will then have its internal diameter substantially flush with the inner diameter of the cylindrical cavity 57. Thus, if one is relying only on the secondary drain opening 53, there will be condensate remaining in the pan because of the lip 54.

In contrast, the primary drain opening 48 as shown in FIG. 7 has no lip because the opening 48 is so located with respect to the front wall 32 that the lower side 58 of the cylindrical cavity 59 is flush with the upper floor portion 38 as shown. Further, it will be seen that the threaded portion 61 is axially offset (i.e. it is vertically lower) from the cylindrical cavity 59 such that when the drain pipe or conduit is screwed into the threaded portion 61, the lower portion of its inner surface will be even with or below the lower surface 58 of the cylindrical cavity 59. In this way, there are no barriers to flow from the opening, and there will be no edges on which debris can catch to start a block up of the drainage opening.

As mentioned above, it is preferable that the pan and its included horizontal right and left drains 28 and 29 be made of a polycarbonate material. Accordingly, each of the openings 48, 49, 51 and 53 have their threaded portion being formed by a brass insert, which provides a better threadable engagement with the drain pipe than would a threaded plastic opening. It also improves hoop strength and resistance to chemical attack induced by the use of the pipe dopes.

Figure 8:
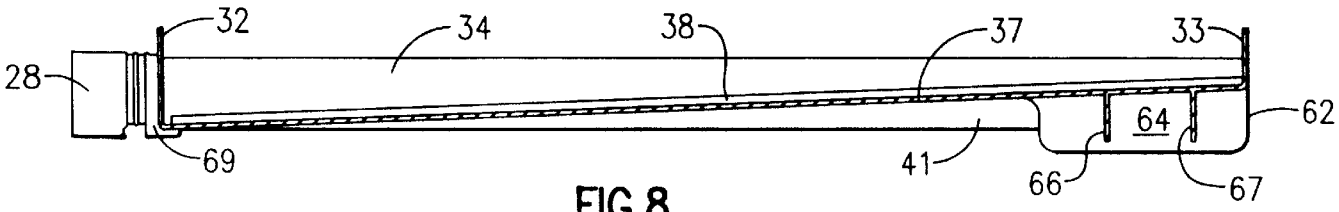
FIGS. 8 and 9 are sectional views of the central rib portion of the present invention as seen along lines 8—8 and 9—9, respectively, of FIG. 5.
Figure 9:
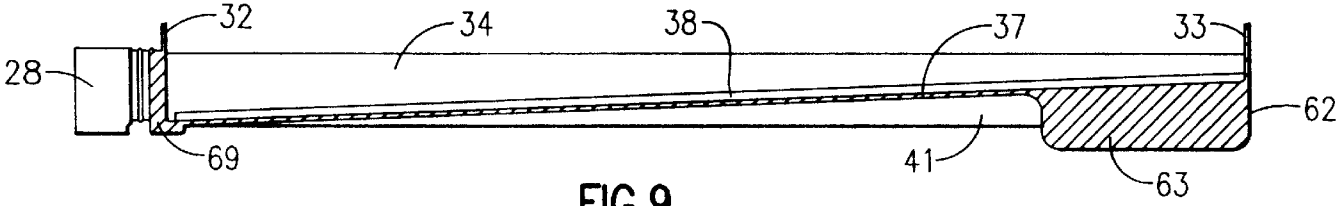
Figure 10:
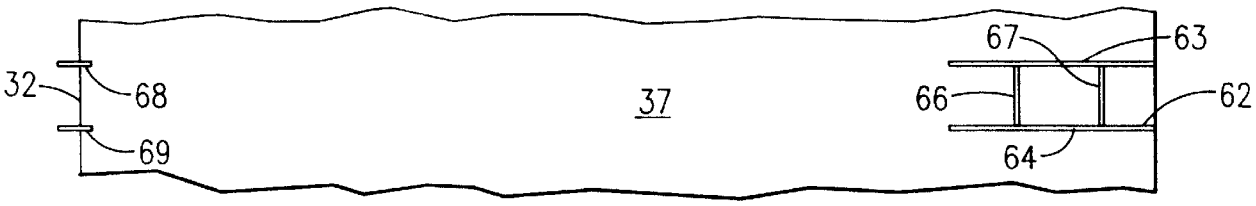
FIG. 10 is a partial bottom view of the condensate pan of the present invention.

Referring now to FIGS. 8, 9 and 10, on the under side of the condensate pan 22, a riser 62 extends downwardly from the central rib 37, near the back end wall 33 as shown. The riser 62 comprises a pair of spaced support ribs 63 and 64, with reinforcement ribs 66 and 67 disposed therebetween. The purpose of the riser 62 will be described hereinbelow.

At the other end of the central rib 37, there is formed on the end wall 32, a pair of ribs 68 and 69 which are provided to assist in the placement and support of the condensate pan 22 within the framework of the fan coil unit 11.

Referring now to the installation and operation of the condensate pan 22 in the fan coil unit 11, a horizontal right installation as shown in FIG. 1 will be described. The drain tube 26 is first secured to the right side of the condensate pan. The A-coil is then placed into the pan, with the right foot 23 being set into the lower floor portion 43 of the left-hand side. In this position, the majority of the weight of the A-coil is on the left side of the condensate pan 22 such that it tends to tilt about the central axis defined by the riser 62 and the rib 69. As a result, when the coil and pan are inserted into the unit 11 and the feet of the coil are attached to the frame by brackets, the lower floor portion 43 of the pan 22 is tipped down to be flush with the right wall 19. In contrast, the lower floor portion 44 on the right side of the condensate pan 22 is raised from a neutral horizontal reference plane such that all of the condensate dropping down from the coil 13 into the pan 22 will tend to run towards the left side of the condensate pan 22 and toward the horizontal right drain 28. Because of the lower placement of the primary drain opening 48 as described hereinabove, the condensate will be substantially drained from the condensate pan 22, with little or no water being left for microbial growth or splashing out of the pan due to excessive air flow and the like. In the event that the primary drain opening becomes clogged, or is otherwise unable to handle the flow of condensate, the water level will rise to the point where the secondary drain opening becomes active to drain the condensate pan as desired.

Similarly, in a right horizontal application as shown in FIG. 2, the condensate collection assembly 26 is installed in the left side of a condensate pan 22 and the A-coil is placed with its left foot 27 in the right side of the pan, and with its apex 24 on the bracket 26. Again, the pan is tipped about its central axis, but this time the right side is tipped lower such that the lower floor portion 44 is low and the lower floor portion 43 is high. The primary drain opening 51 is now the effective one, with the secondary drain opening 53 being the backup.

With the structure and installation as described, the condensate pan will contain a minimum amount of water during and after operation of the system. However, the pan will provide sufficient capacity to overcome a dry trap at the start of operation. That is, at the start of a season, for example, when there is no condensate in the trap the flow of air will be drawn up through the trap to prevent the flow of condensate out of the pan but, since the collected condensate is directed to flow forward the outlet because of the slopes of the pan, there will eventually be a sufficient amount of condensate in the pan to overcome the pressure of the incoming air flow so as to fill the trap with condensate and thereby "make" the trap.

Although this invention has been shown and described with respect to a preferred embodiment, it will be understood by those skilled in the art that various changes in the form and detail thereof may be made without departing from the true spirit and scope of the claimed invention.

What is claimed is:

1. A condensate pan of the type having a floor, front and back end walls, and left and right side walls, and having a drain opening arrangement in the front end wall for draining off condensate that collects in the pan, wherein the improvement comprising:

said drain opening arrangement having first and second openings, said first opening providing for fluid flow from said pan and having an inner surface of its lower wall in substantially the same plane as said pan floor at the point of intersection, and said second opening providing for alternate fluid flow from said pan and having an inner surface of its lower wall disposed vertically above the inner surface of said first opening lower wall.

2. A condensate pan as set forth in claim 1 wherein said condensate pan and drain opening arrangement are integrally formed of a polycarbonate material.

3. A condensate pan as set forth in claim 1 wherein said first opening is cylindrical about an axis except for said lower wall inner surface which forms a chord.

4. A condensate pan as set forth in claim 3 wherein said second opening is cylindrical about an axis which is upwardly offset from said first opening axis.

5. A condensate pan as set forth in claim 1 wherein said second opening is threaded for interconnection with a conduit.

* * * * *